US007097033B2

(12) United States Patent
Koefelda et al.

(10) Patent No.: US 7,097,033 B2
(45) Date of Patent: Aug. 29, 2006

(54) STACKABLE LOW DEPTH CASE WITH HANDLE STRUCTURE

(75) Inventors: Gerald R. Koefelda, Hermosa Beach, CA (US); Donald L. Bell, Hollywood, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/227,631

(22) Filed: Aug. 24, 2002

(65) Prior Publication Data

US 2003/0057211 A1 Mar. 27, 2003

Related U.S. Application Data

(63) Continuation of application No. 09/326,283, filed on Jun. 5, 1999, now abandoned.

(51) Int. Cl.
*B65D 65/00* (2006.01)

(52) U.S. Cl. ..... 206/427

(58) Field of Classification Search ..... 206/201, 206/203, 427, 509, 510; 220/516–518, 509
See application file for complete search history.

(56) References Cited

U.S. PATENT DOCUMENTS 4,899,874 A 2/1990 Apps et al.
4,928,841 A * 5/1990 Arthurs ..... 220/516
4,978,002 A * 12/1990 Apps et al. ..... 206/201
D327,357 S 6/1992 Rehrig
D356,211 S 3/1995 Apps et al.
D361,663 S 8/1995 Kalin
5,465,843 A * 11/1995 Koefelda ..... 206/509
5,487,487 A * 1/1996 Hammett ..... 220/509
5,495,945 A 3/1996 Apps et al.
5,501,352 A 3/1996 Apps
5,529,176 A 6/1996 Apps et al.
D378,249 S 3/1997 Apps et al.
5,651,461 A 7/1997 Apps et al.
5,660,279 A 8/1997 Apps et al.
5,704,482 A 1/1998 Apps et al.
5,842,572 A 12/1998 Apps et al.
5,913,424 A * 6/1999 Kelly et al. ..... 206/509
5,979,654 A 11/1999 Apps

* cited by examiner

*Primary Examiner*—Luan K. Bui

(57) ABSTRACT

A handle structure for a low depth case for holding containers is provided. The low depth case includes a bottom portion and a pair of opposing sidewalls. The handle structure is disposed in a side wall and is adapted for handling by a user in one of a palm-up or palm-down orientation. The handle structure includes an inner wall member and an outer wall member. The outer wall member is disposed in a corresponding one of the pair of opposing sidewalls. The outer wall is also attached to the inner wall member to define a finger receiving area therebetween. The outer wall member has an upper portion and a lower portion which has a lower edge. The lower portion and corresponding sidewall define a hand-opening area which extends into the low depth case.

40 Claims, 20 Drawing Sheets

STACKABLE LOW DEPTH CASE WITH HANDLE STRUCTURE

This application is a Con of Ser. No. 09/326,283, filed on Jun. 05, 1999. Now abandoned.

TECHNICAL FIELD

This invention relates to a stackable low depth case having a handle structure feature.

BACKGROUND ART

Plastic bottles and other similar containers are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive loads is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. Cases of bottles are customarily stacked on top of each other. In warehouses, cases of bottles are frequently stacked on pallets which can be lifted and moved about by fork-lift trucks. The stacks of cases on the pallets must therefore be particularly stable in order to remain standing in the face of the jostling inherent in being moved about. A technique for interconnecting columns of cases, called "cross stacking," is often used to improve the stability of cases of bottles loaded on a warehouse pallet. Cross stacking generally involves stacking rectangular bottle cases to build up a layered structure, with each layer having cases oriented parallel to each other and with the cases in adjacent layers being oriented at right angles to each other. Since each case in the cross-stacked layer rests on at least two cases in the layer below, the cases of the cross-stacked layer tend to keep the cases on which they rest from moving apart from each other. The cross-stacked layer therefore stabilizes the structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer.

One solution to the problems of full depth corrugated-paper cartons is plastic full depth cases. In plastic full depth cases, the sides are load bearing. Full depth plastic cases also have numerous disadvantages. They are expensive to manufacture. They are also expensive to ship and to store empty in a user's warehouse as they require a great deal of space. Also, they may totally or partially surround the bottles, thereby preventing or minimizing the display of the bottles.

To overcome these problems plastic low depth cases have been used. A low depth case is one in which the side walls are lower than the height of the stored bottles or containers, and in which the containers support the weight of additional cases stacked on top.

Such cases may be stacked high above a person's head, may be placed low on the ground, or anywhere in between. However, providing a means to lift, carry and handle such cases is often difficult due to space and size considerations for the case and its environment. In other words, additional case details and features typically lead to larger overall dimensions for the case, and therefore reduces the amount of product that can be placed on a pallet or in a truck. Additional case details typically also means that the cases do not sit comfortably upon a pallet, but instead may overhang the sides, which is not a desired result.

Consequently, there is a need for a container case of the low depth variety which is efficient in terms of design size and shape. Such case design should be capable of placement on a standard pallet with other similar cases so that it fits with little or no overhang. This case should also include a manner by which to carry and handle the case which does not interfere with the efficiency of the design, and allows the case to be handled or lifted at any number of contemplated heights at which it may be stacked or rested.

DISCLOSURE OF INVENTION

It is an object according to the present invention to provide a container case which is efficiently designed from the viewpoint of size and shape so that it can be easily palletized, handled, and transported.

It is also an object according to the present invention to provide a means by which the case can be carried, lifted and handled when it is resting at various heights, such as on the floor or a table, or stacked high.

It is a further object according to the present invention to provide a handle structure for a low depth case which may be grasped by a user in multiple orientations for maneuvering the low depth case thereby.

In carrying out the above objects, features and advantages of the present invention, a handle structure for a low depth case for holding containers is provided. The low depth case includes a bottom portion and a pair of opposing sidewalls. The handle structure is disposed in a side wall and is adapted for handling by a user in one of a palm-up or palm-down orientation. The handle structure includes an inner wall member and an outer wall member. The outer wall member is disposed in a corresponding one of the pair of opposing sidewalls. The outer wall is also attached to the inner wall member to define a finger receiving area therebetween. The outer wall member has an upper portion and a lower portion which has a lower edge. The lower portion and corresponding sidewall define a hand-opening area which extends into the low depth case. The handle is operably by a user such that in the palm-up orientation the user's fingers extend into the hand-opening area so that the user's palm faces up such that when the user exerts force against the lower edge, the low depth case may be raised. Further, in the palm-down orientation, the user's fingers wrap around the upper portion of the outer wall and extend into the finger receiving area, such that the user may maneuver the case.

The above objects and other objects, features and advantages of the present invention are readily apparent from the following detailed description of the best modes for carrying out the invention when taken in connection with the accompanying drawings.

BEST MODE FOR CARRYING OUT THE INVENTION

Figure 1:
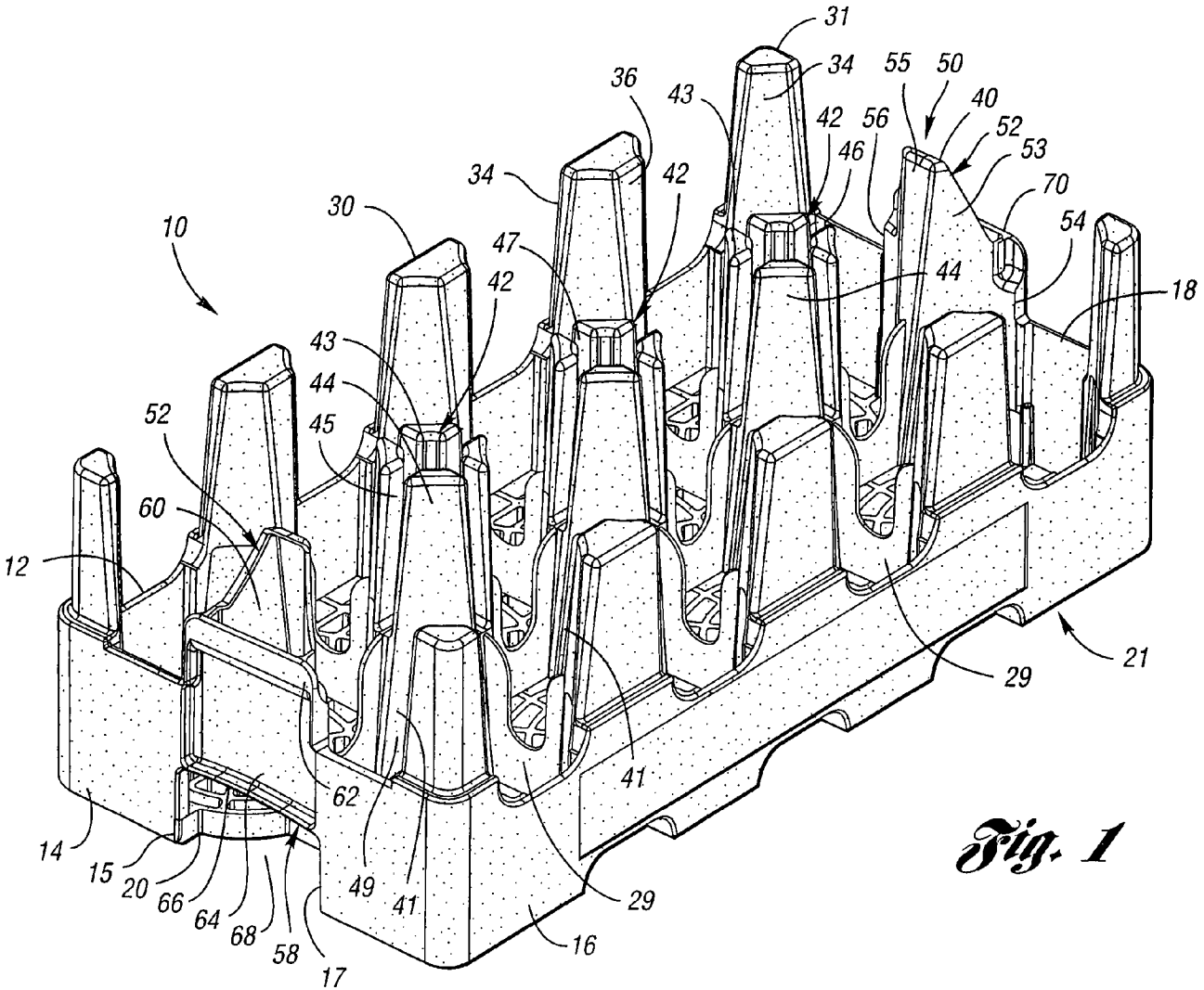
FIG. 1 is a perspective view of the preferred and first embodiment of a stackable low depth bottle case according to the present invention.
Figure 3:
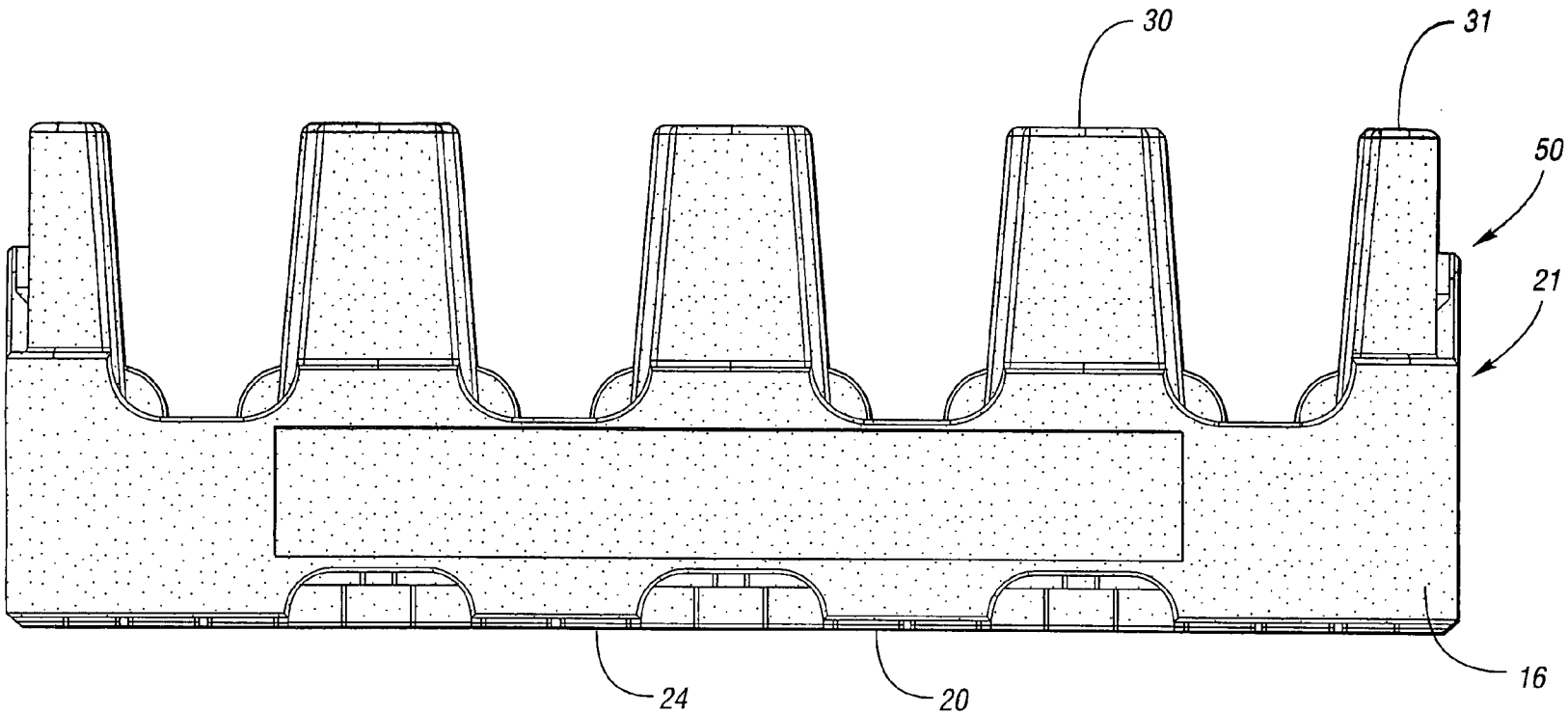
FIG. 3 is a side elevational view of the first embodiment.

As illustrated in FIG. 1 of the drawings, a first and preferred embodiment of a stackable low depth case 10 according to the present invention is provided. Case 10 is adapted for receiving and storing bottles or other containers. Case 10 has four side walls 12, 14, 16, 18. Side walls 12, 16 are relatively long and side walls 14, 18 (or end walls) are relatively short. Case 10 and side walls 12, 14, 16, 18 in one embodiment have a single wall construction. Case 10 as illustrated in FIG. 1 is rectangular and is symmetrical about both central axes. However, it is contemplated that the teachings according to the present invention may equally apply to a non-symmetrical case. The depth or height of side walls 12, 14, 16, 18 is preferably relatively low compared to the height of the bottles or containers retained therein. The ratio of the length of long side walls 12, 16 to the length of short side walls 14,18 is substantially equal to the ratio of the number of bottles the case holds in the lengthwise direction to the number of bottles the case holds in the widthwise direction. For example, the 8-container case illustrated in the drawings is twice as long as it is wide and holds containers in a 4×2 relationship. FIG. 3 illustrates an elevational view of case 10 at side wall 16.

Figure 4:
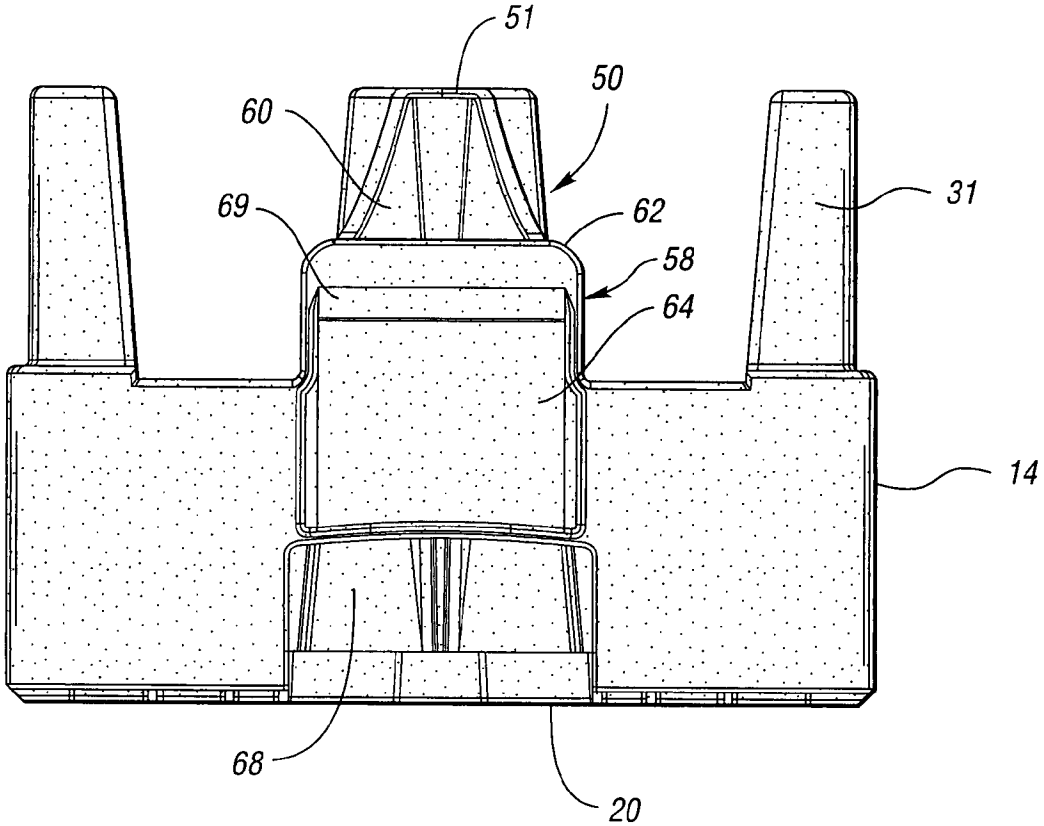
FIG. 4 is an end elevational view of the first embodiment.
Figure 5:
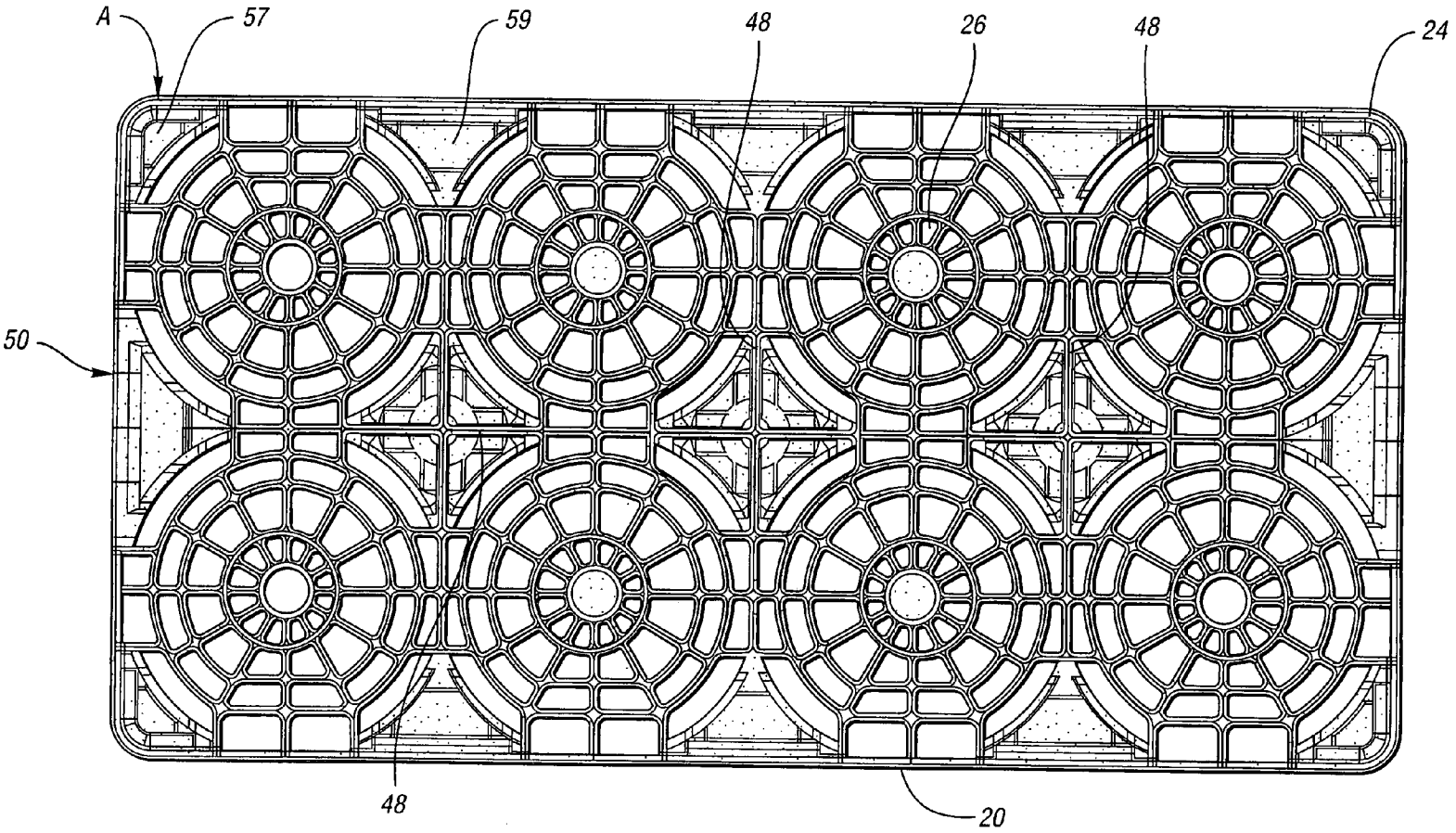
FIG. 5 is a partial bottom plan view of the first embodiment.

As best shown in FIGS. 4 and 5, case 10 also includes a bottom portion 20 attached to side walls 12, 14, 16, 18 to form the outer shell 21 of case 10 (see FIGS. 1 and 3.) Preferably, case 10 is made from plastic and is molded integrally as a single component. Bottom portion 20 has an upper surface 22 and a lower surface 24. Upper surface 22 is substantially flat (see FIG. 2). Lower surface 24 includes a plurality of elliptical concave portions 26 disposed thereon. The number of concave portions 26 corresponds to the number of bottles/containers the case is designed to retain. The function of concave portions 26 is described below.

Case 10 is formed having a plurality of low profile vertical walls 29 and upwardly projecting columns 30, 31 (outer castle portions) around the perimeter of case 10, and also additional upwardly projecting central columns 42 (central castle portions) which are disposed inward of side walls 12, 14, 16, 18. Vertical walls 29 extend to the top surface of bottom portion 20. The side edges of vertical walls 29 abut columns 42 and help to secure columns central 42 to bottom portion 20. Vertical walls 29, side outer columns 30, corner columns 31, and central columns 42, when combined with upper surface 22 of bottom portion 20 and sidewalls 12, 14, 16, 18, define a plurality of container retaining pockets 32.

Columns 30, 31, 42 extend above bottom portion 20 a distance approximately one third of the height of the bottles or other containers to be retained in case 10. This increases the effective height of the case while maintaining high container visibility and low manufacturing costs. For example, where cases 10 are shaped to retain 2-liter bottles, columns 30, 31, 42 extend upwardly approximately four inches. As noted columns 30, 31 are disposed either along walls 12, 14, 16, 18, or columns 42 are disposed away from the walls, centrally within bottom portion 20. Columns 31 disposed in the corners between two adjacent walls 12, 14, 16, 18, have one curved surface 34. Columns 30 disposed on the sides of one of the walls have two curved surfaces 34 and one flat surface 36 disposed therebetween. The two curved surfaces 34 on side columns 30 help define two separate and adjacent container retaining pockets 32. Flat surface 36 is disposed between these two bottle retaining pockets.

Figure 2:
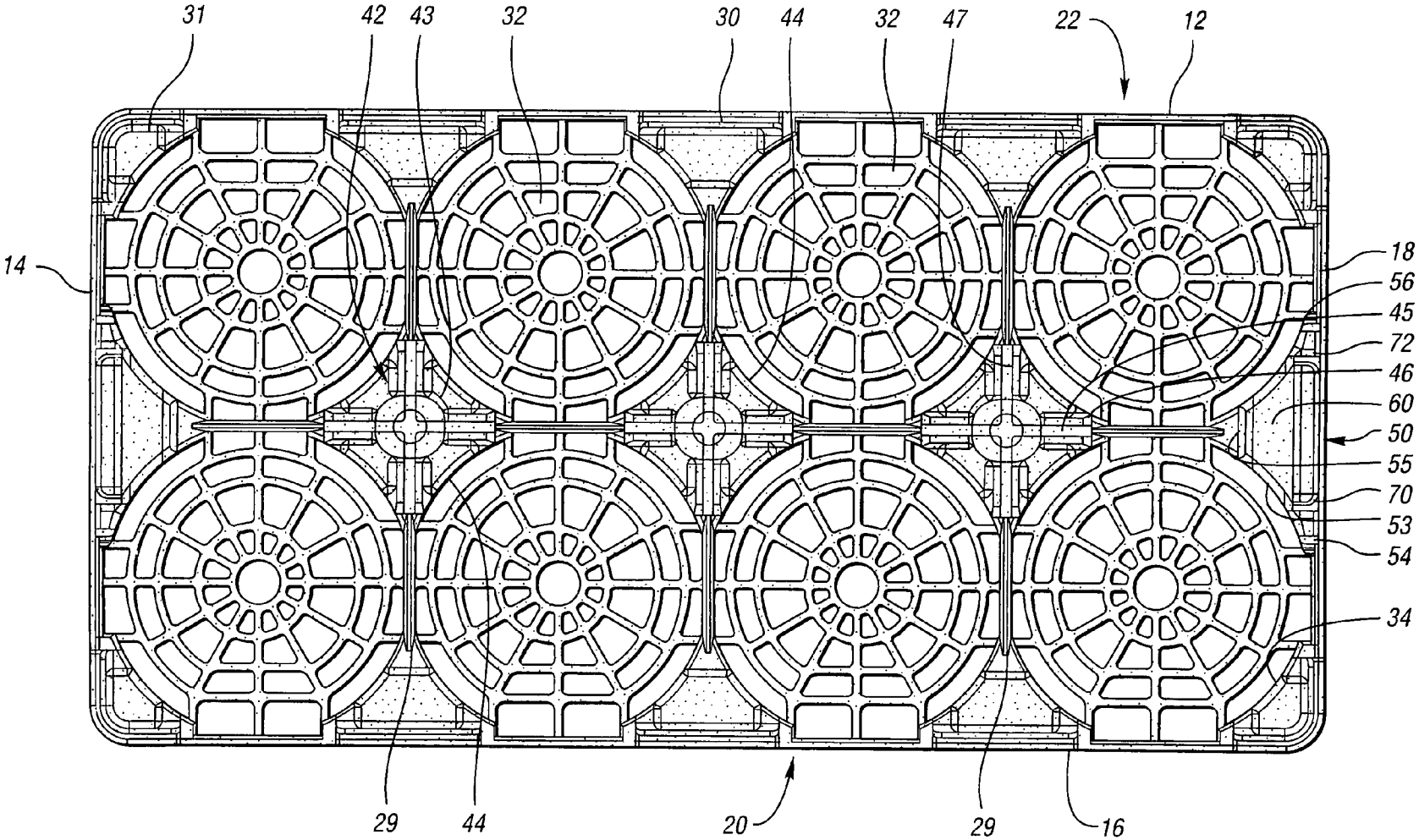
FIG. 2 is a top plan view of the first embodiment.
Figure 7:
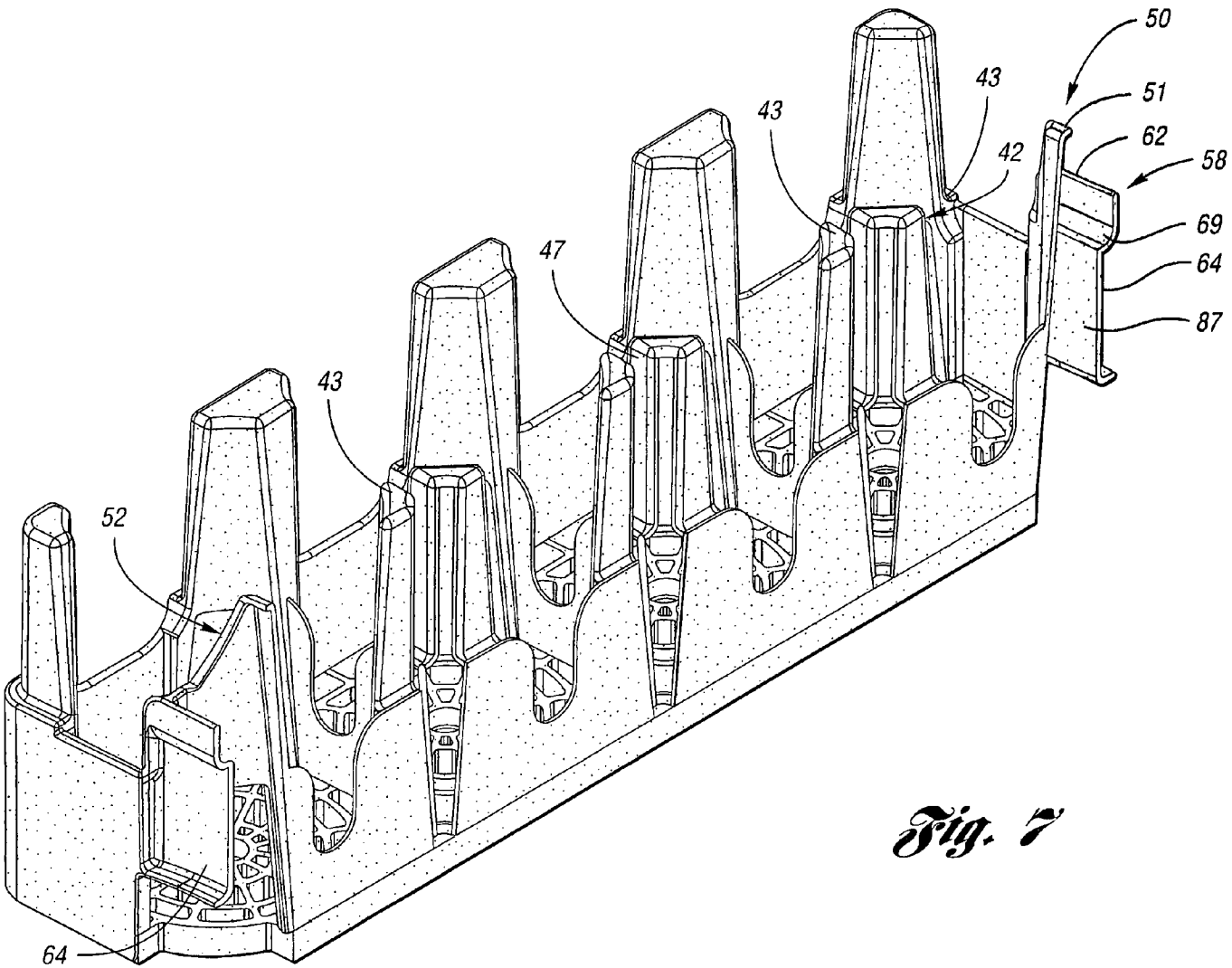
FIG. 7 is a perspective view of the cross-section shown in FIG. 6.

As illustrated in FIGS. 1, 2 and 7, central columns 42 have four alternating curved portions 43, having curved surfaces 44, and four alternating flat planar surface areas 46. Each curved surface 44 has a window 41 disposed below it. Planar surface areas 46 and a small portion of curved surfaces 44 (bordering window 41) extend down to and contact upper surface 22 of bottom portion 20.

Curved surfaces 44 are upwardly tapered from upper surface 22, and along with window 41, provides for nesting with a similar empty container disposed thereunder.

The four curved surfaces 44 define portions of four container retaining pockets 32 and four flat surface areas 46 separate these pockets. Four curved surfaces 34, 44 on four separate columns 30, 31, 42 form the four corners of a container retaining pocket 32. Thus, columns 30 having two curved surfaces 34 form a corner of two adjacent container retaining pockets 32, and columns 42 having four curved surfaces 44 form a corner of four adjacent container retaining pockets 32. As seen in FIGS. 1, 2, 6 and 7, central columns 42 each have recesses 45 and 47 formed therein. Recesses 45 extends through columns 42 along the longitudinal axis of case 10. Recesses 47 extend through columns 42 substantially perpendicular to recesses 45. Recesses 45 and 47 extend downwardly to a height which substantially equals a side wall height.

A plurality of wall portions 49 are disposed directly below columns 42 (and recesses 45,47) and are defined outwardly by planar surfaces 46. Such wall portions 49 are co-planar with vertical walls 29. Wall portions 49 extend to lower surface 24 of bottom portion 20, and can be identified in the partial bottom plan view of FIG. 5 as the plus or cross (+) portions 48. In a nested orientation when case 10 is empty, recesses 45,47 are for receiving a plus portion 48 of an identical upper case. Such cross portions 48 also provide a barrier for when cases 10 are full (or partially full) and are being stacked on top of each other or for when they are being unstacked. Under such circumstances, when a case is being lifted or slid across a plane of bottle tops, cross portions 48 provide a barrier so that cases 10 slide freely, such that the bottle tops do not interfere with or get caught up in the recesses which would exist if columns 42 were hollow. FIG. 5 also illustrates a plurality of openings 57, 59 in lower surface 24 which during a nested orientation each receive therein a corresponding corner column 31 and side column 30, respectively. FIG. 5 is best and most completely represented by the area designated as area A.

Upper surface 22 of bottom portion 20 within container retaining pockets 32 is substantially flat. This allows for retention of containers regardless of the configuration of the bottom of the containers. Also, this allows petaloid bottles to be rotated within the container retaining pockets 32 to facilitate display of the product. The low depth feature of case 10 further enhances product display and identification.

The elliptical concave portions 26 of lower surface 24, shown in FIG. 5, allow cases 10 filled with bottles/containers to be vertically stacked for transportation, storage, and display purposes. Concave portions 26 are formed of ribs or projections which define the concave shape. Lower surface 24 has a plurality of concave areas 26, each of which is generally elliptical and has a taper around it to allow for some play in alignment in a stacked orientation.

In keeping with the present invention, side walls 14, 18, are formed with handle structure portions 50 to facilitate the carrying and handling of case 10. The first embodiment according to the present invention includes a preferred handle structure 50. As previously noted with respect to case 10 and as further illustrated in FIG. 1, handle structure 50 is generally symmetrical about the longitudinal axis of case 10. Handle structure 50 is designed to accommodate carrying and handling by a user in both a palm-up and palm-down manner, as described herein.

Figure 8:
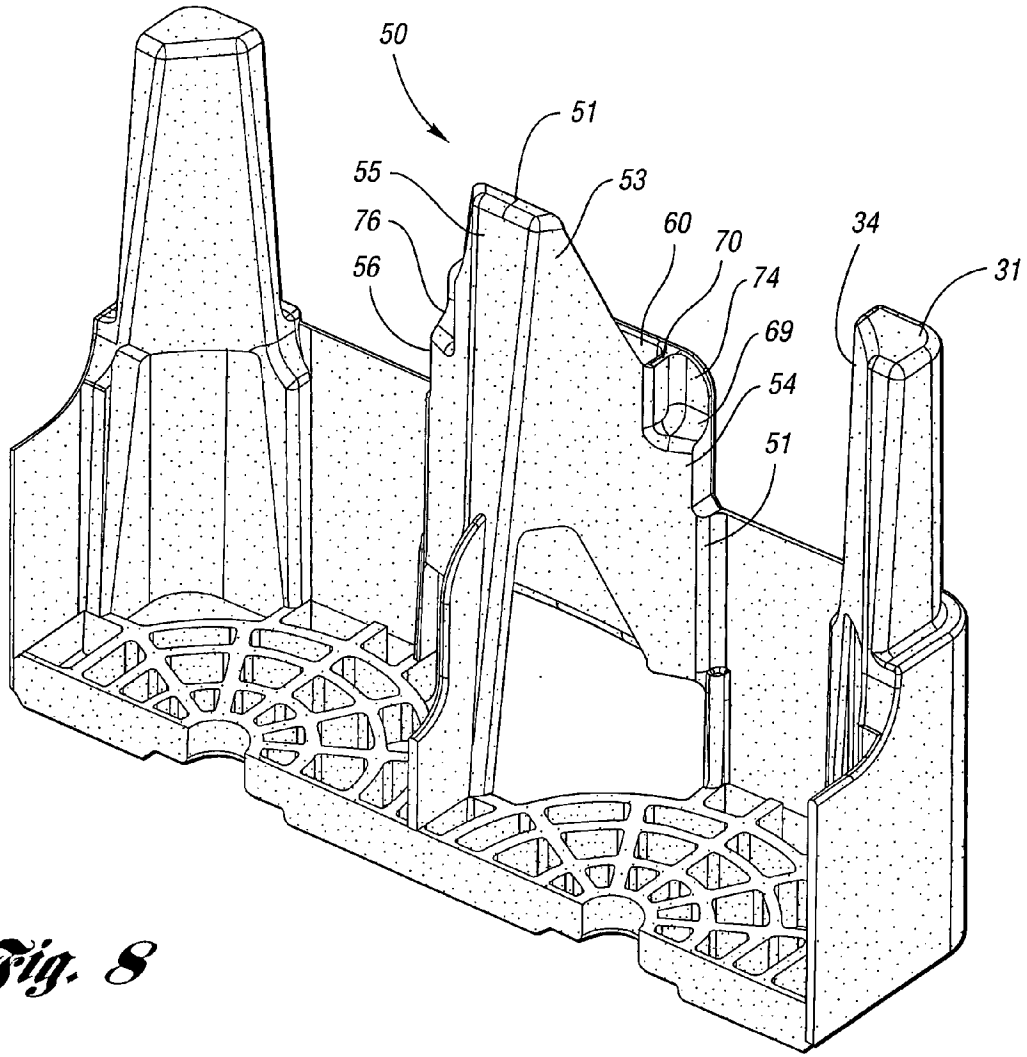
FIG. 8 is an enlarged perspective view of the handle structure feature of the first embodiment.

With particular reference to the enlarged perspective view of FIG. 8, handle structure 50 includes an inner wall member 52 defined by an upwardly projecting castle (handle column) portion 40 which is substantially the same height as columns 30, 31, 42. Inner wall member 52 includes two curved surfaces 53 and a flat surface 55. As with previous curved surfaces 34, curved surfaces 53 assist in defining the two container retaining pockets 32 adjacent handle structure 50. As further shown in FIG. 8, inner wall member 52 is truncated by a generally planar surface 51 for attachment with an outer wall portion 58. As illustrated in FIGS. 1, 4, 6, and 7, outer wall portion 58 includes an upper portion 62 which is substantially coplanar with end wall 14, as shown in FIG. 3. Outer wall portion 58 also includes a lower recessed portion 64 (FIGS. 1, 4, and 7). Inner wall portion 52 and outer wall portion 58 define therebetween a finger receiving area 60, which is also illustrated in FIGS. 1, 2, 4 and 8, and is described in association with the palm-down orientation and FIG. 10.

Figure 9:
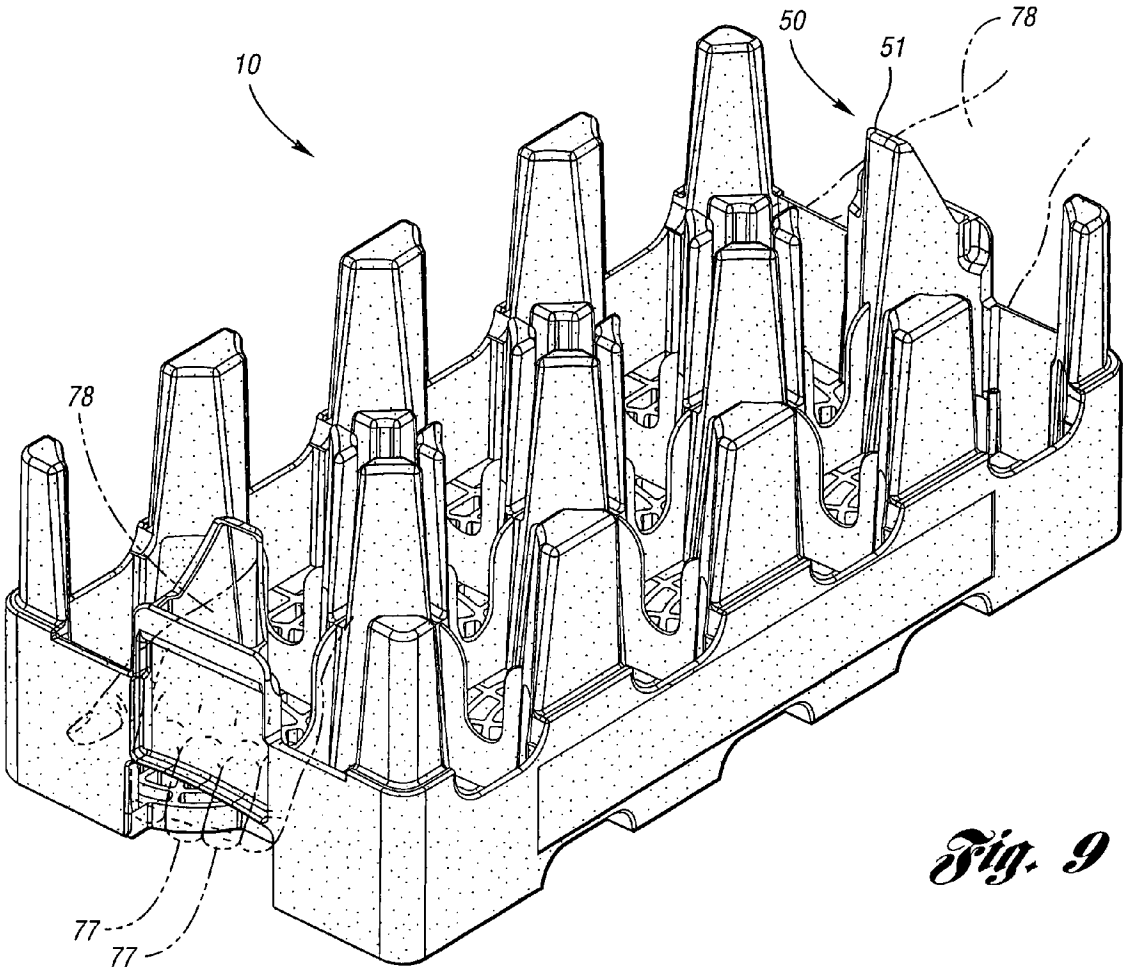
FIG. 9 is a perspective view of the case of the first embodiment showing a user's hands grasping the handle structure in a "palm-up" orientation.

As best shown in FIG. 1, note that a lower edge 66 of recessed portion 64, together with inner edges 15 and 17 of end wall 14, define therebetween another receiver opening 68 for receiving a user's fingers or hands in a palm-up orientation as disclosed further herein, in association with FIG. 9.

Figure 6:
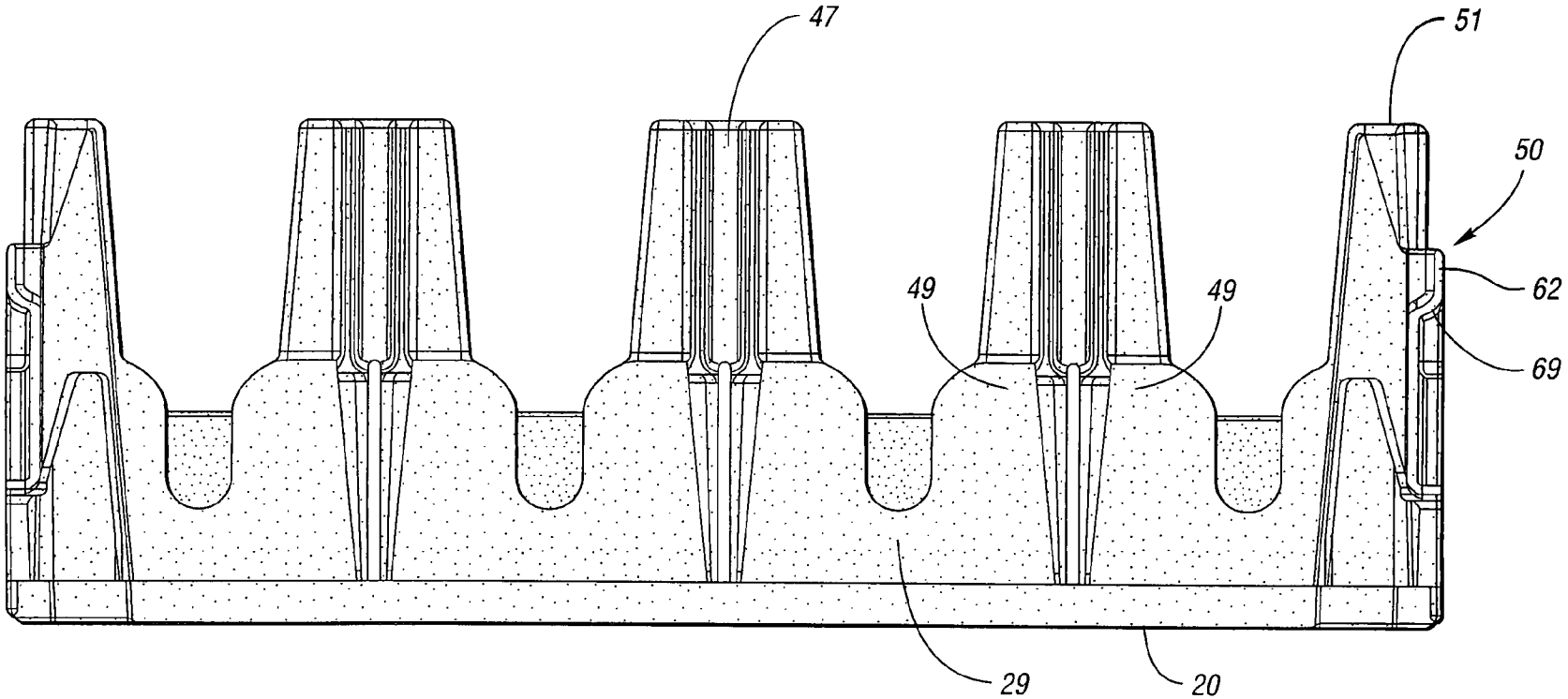
FIG. 6 is a cross-sectional view taken along the longitudinal center line of the first embodiment.

As further shown in FIGS. 4, 6, 7, 8, recessed lower wall portion 64 of outer wall 58 is further defined by an upper surface 69 which provides a transition portion between outboard upper portion 62 and recessed lower portion 64. As shown in FIGS. 6 and 7, transition portion 69 has an arcuate shape defining the transition between wall upper and portions, 62 and 64, respectively. However, it is fully contemplated that transition portion 69 may be linear instead of curved, and oriented in either a horizontal or angled orientation without detracting from the objects and goals of the present invention.

Also, as shown in FIGS. 1, 2, and 8, finger receiving portion 60 in this embodiment is transversely defined on each side by a rib member 70, 72, wherein rib members 70,72 and transition surface 69 define two outboard finger receiving areas (or "fins") 74 and 76 (FIGS. 1 and 8). Of course, depending on the location of rib members 70,72—for example, if moved outboard—finger receiving portion 60 may be formed sufficiently large to receive additional user fingers, such that fins 74,76 are not necessary. Likewise, a rib member may be positioned inboard within portion 60 to define finger receiving pockets therein.

Figure 10:
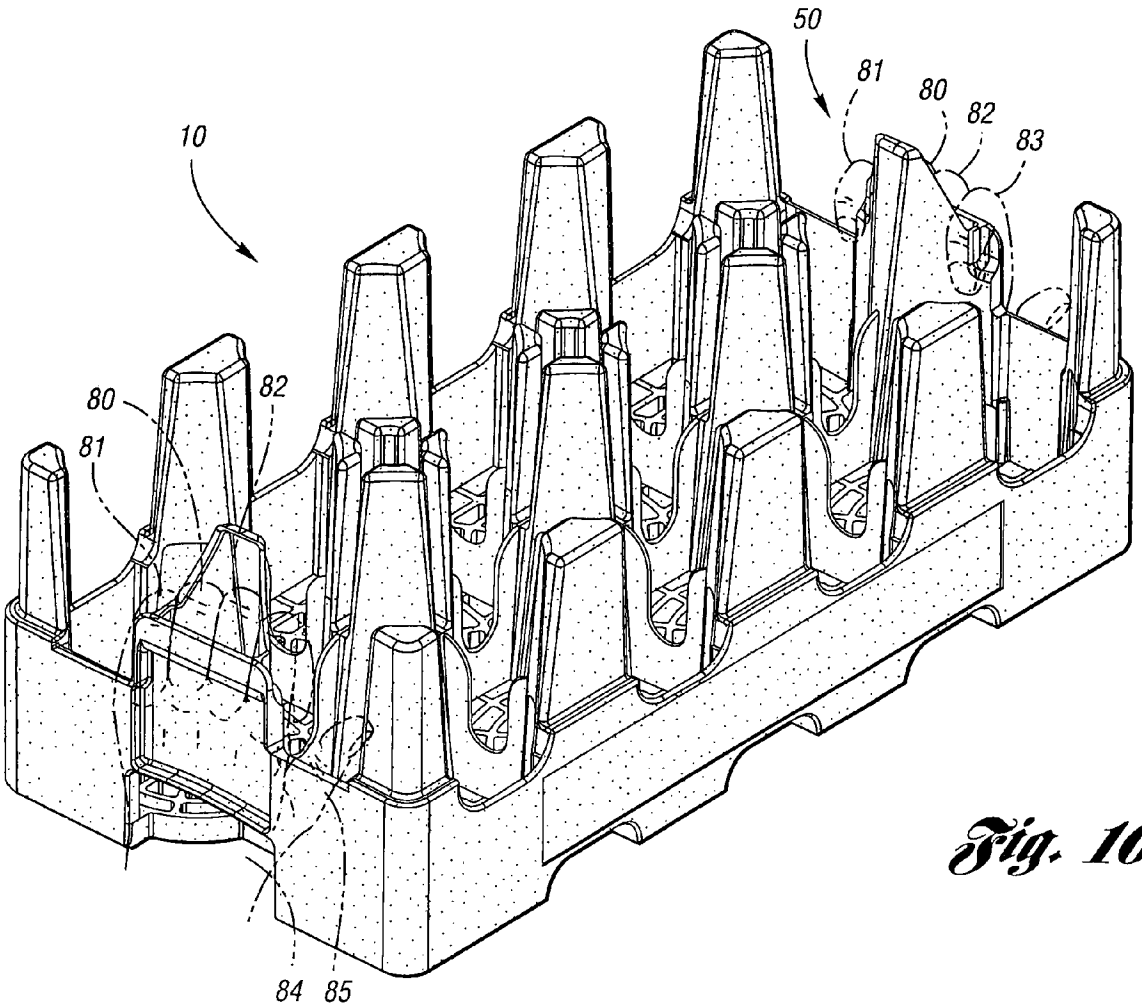
FIG. 10 is a perspective view of the case of the first embodiment showing a user's hands grasping the handle structure in a "palm-down" orientation.

Given the aforementioned structure of handle structure 50 of the first embodiment of case 10, focus is now directed to FIGS. 9 and 10. The function and handling of case 10 by way of handle structure 50 is described. Particularly, handle structure 50 of case 10 may be utilized by a user in one of two user hand orientations: palm-up (FIG. 9) or palm-down (FIG. 10), as disclosed herein.

FIG. 9 illustrates handle structure 50 of case 10 being handled by a user in a "palm-up" orientation. Generally, the palm-up orientation is utilized by a user when case 10 is disposed on a floor, table or any other surface which generally would not necessitate that the user raise his/her hands above shoulder level. Accordingly, just as one would pick up a stack of books off the floor, the user inserts his hand 78 or various fingers 77 palm side up or toward case 10, into the relatively larger finger/hand receiving area 68 and lifts case 10. (The fingers are inserted from outside case 10 toward the interior of case 10.) The hand and fingers are shown in phantom for ease of observation and reference in conjunction with the drawing. While lifting case 10, the user grasps edge 66 while the fingers 77 are generally curling upward into case 10 and resting against the inner surface of 87 of recessed portion 64. Hence the palm-up orientation is provided by this lifting and handling procedure.

Reference is now made to FIG. 10 which illustrates the "palm-down" orientation for a user handling case 10. Generally, the design accommodates a user who, for example, reaches overhead and pulls case 10 off of a high stack of full (or partially full) stacked cases 10, or pulls case 10 off of a high shelf, which would typically necessitate that the user raise his/her hand(s) above shoulder level. In this manner, the user would insert approximately two more fingers into relatively smaller finger receiving area 60. In this embodiment, the user's two middle fingers (80, 82, not including the thumb 85) are inserted into finger receiving area 60, hand 84 positioned palm side down or toward case 10. Transition surface 69 also extends into finger receiving area to and acts as a stopping member which provides a barrier against the user inserting his finger(s) too far into this opening in an awkward manner for maneuvering or lifting case 10. Also, in this orientation, the user's fifth digit 81 (commonly referred to as the "pinkie finger") and index finger 83 are disposed outside of finger receiving area 60 and rest in one of the outboard finger receiving areas 74, 76. Thus, in this orientation, a user may reach overhead and maneuver or slide case 10 across the surface upon which it rests (such as a shelf or plane of bottle caps) in order to access case 10 and its contents.

Of course, this orientation may also be used when case 10 is empty (and thus has a lighter weight than when full or partially full) or, of course, when the user has sufficient strength to lift the case from the contemplated overhead position. In fact, it is fully contemplated that a user may lift case 10 single-handedly using the palm down orientation.

FIGS. 11–20 illustrate an alternate embodiment of the stackable low depth case 110 according to the present invention. In this alternate embodiment, the shape and construction of handle structure 150 differs from that of handle structure 50 of the first embodiment. The remaining features of case 110 are otherwise substantially the same as the first embodiment. Note that many features and components in the second embodiment which are similar or correspond to features in the first embodiment have a value of 100 added to their corresponding reference number provided in FIGS. 11, 12, 13, 14, 15, 16, 17, 18, 19 and 20.

Figure 11:
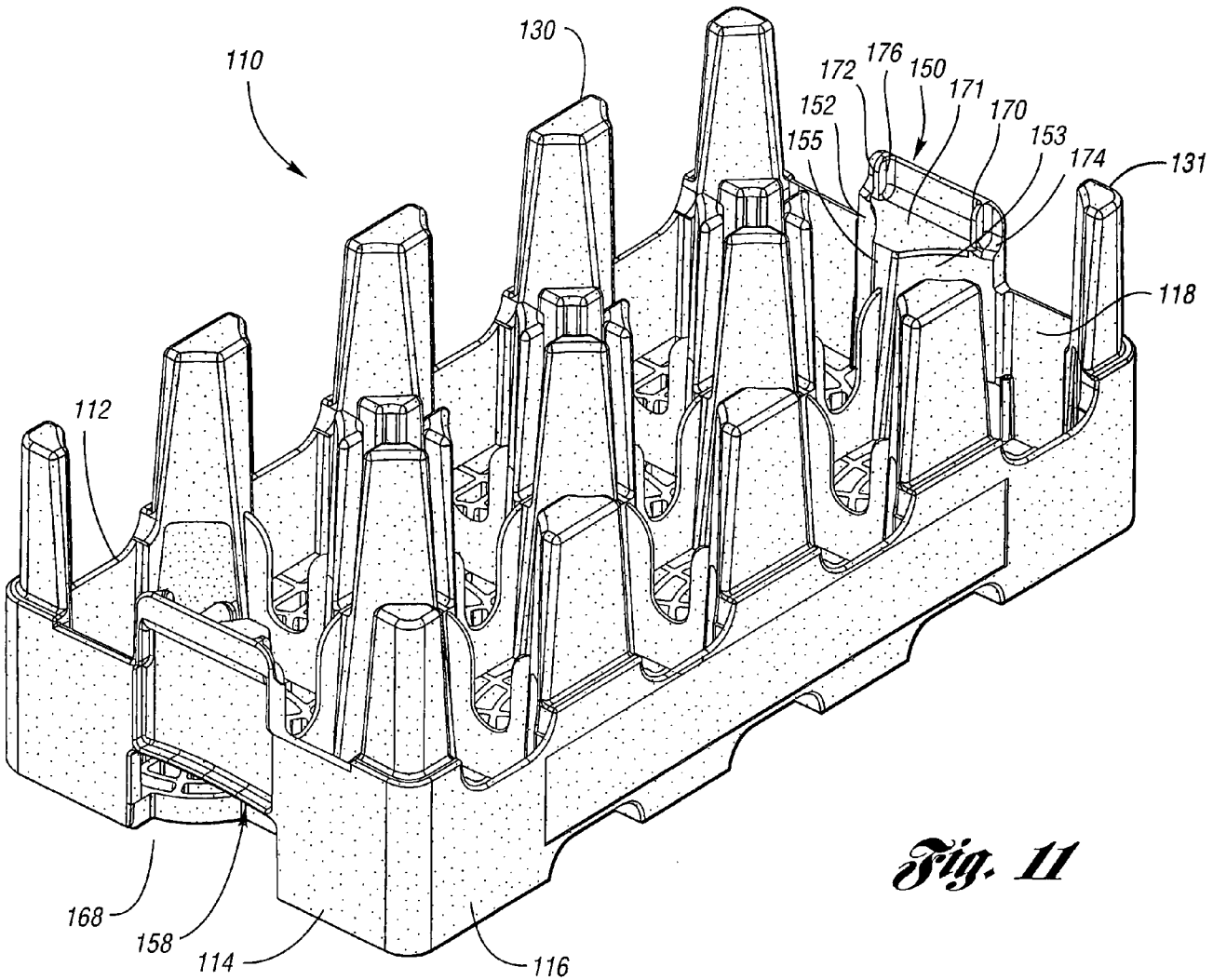
FIG. 11 is a perspective view of the second embodiment of a stackable low depth bottle case according to the present invention.
Figure 16:
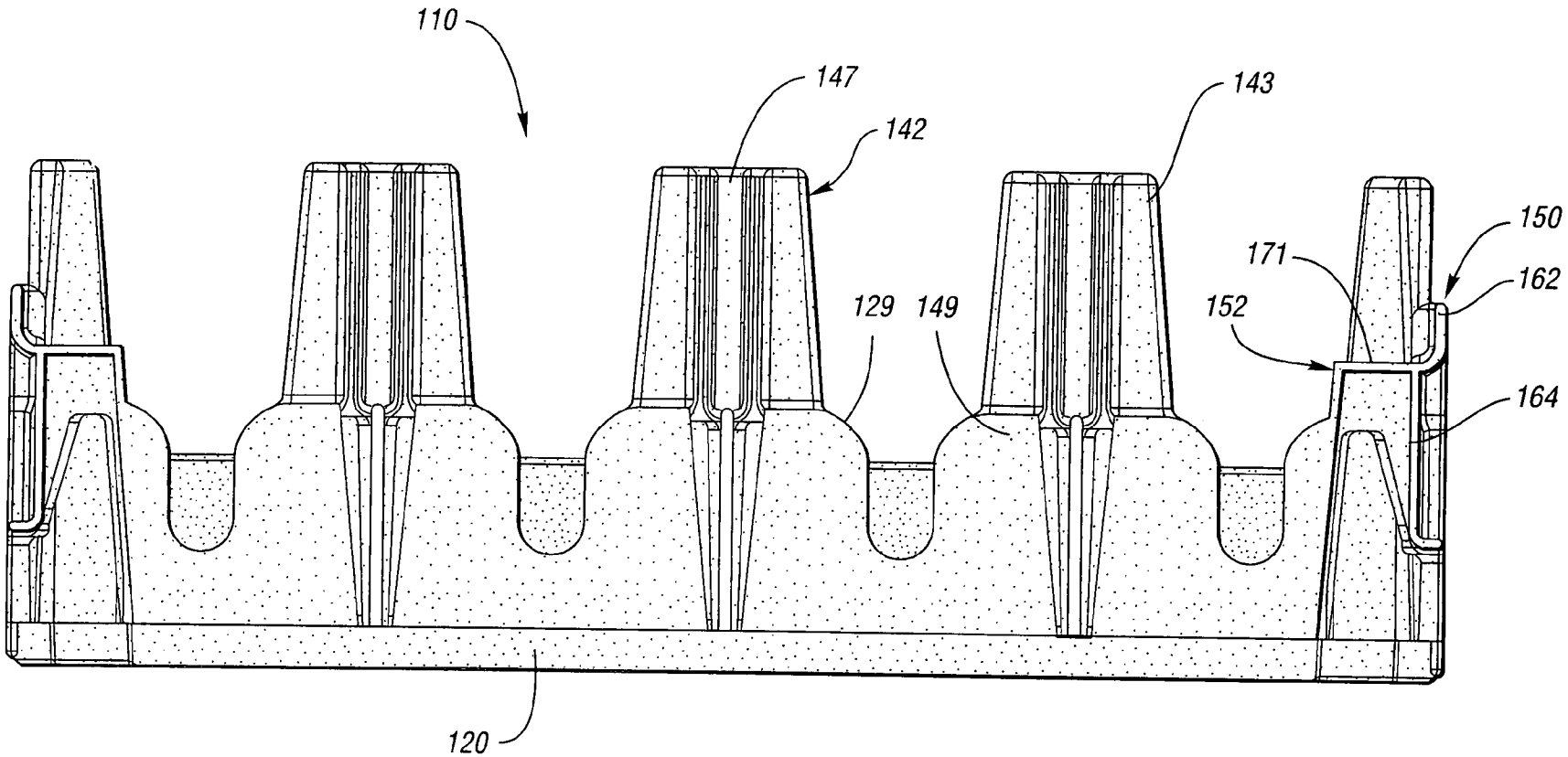
FIG. 16 is a cross-sectional view taken along the longitudinal center line of the second embodiment.
Figure 18:
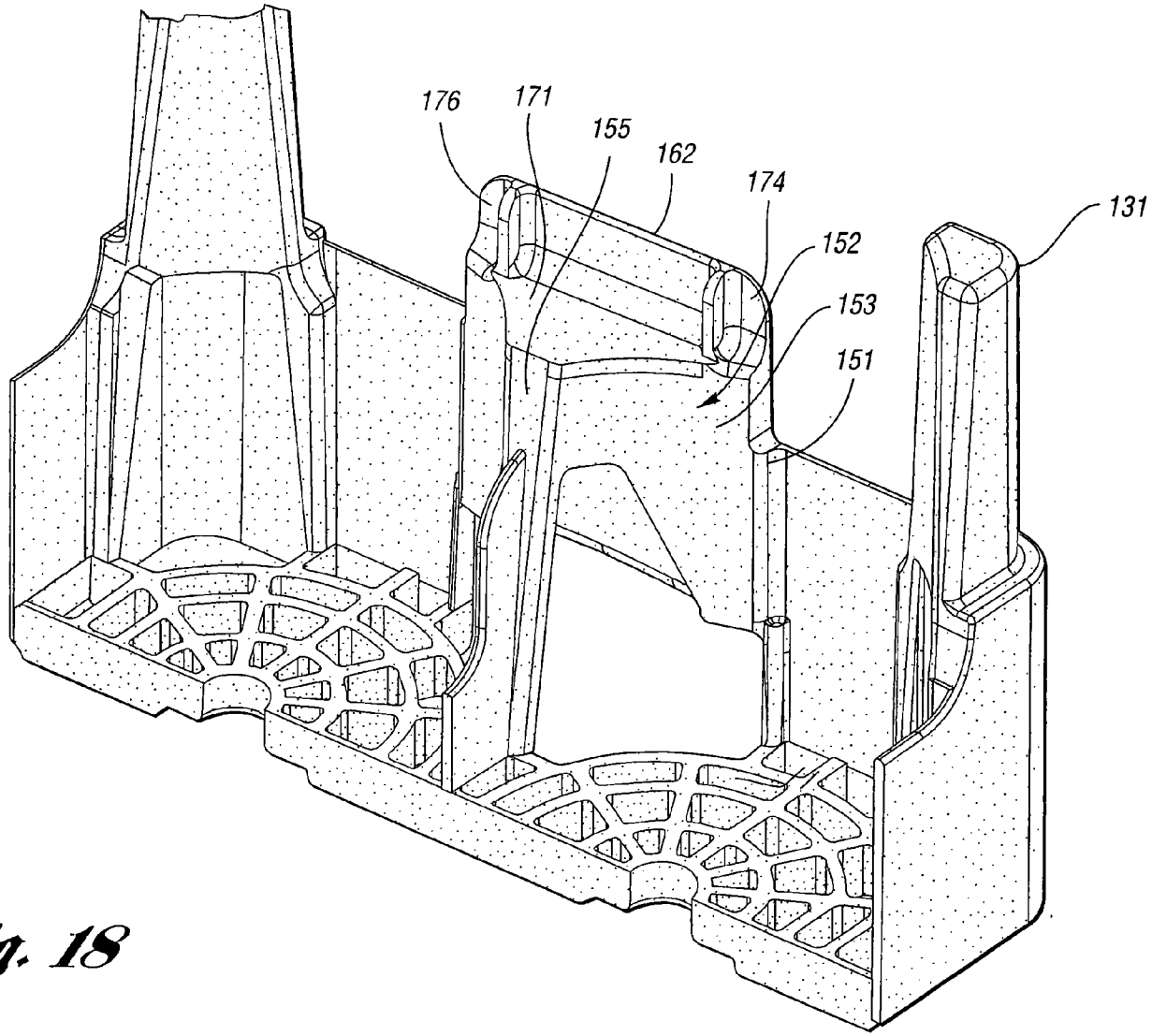
FIG. 18 is an enlarged perspective view of the handle structure feature of the second embodiment.

As with the previous embodiment, handle structure 150 of case 110 includes an inner wall portion 152 defined by two curved surfaces 153 and a flat surface 155, as shown in FIGS. 11, 16 and 18. The upstanding castle portion 40 of handle structure 50 of the previous embodiment has been truncated for this second embodiment, as shown in FIGS. 11 and 18. Curved surfaces 153 assist in defining the two container retaining pockets 132 adjacent handle structure 150. Curved surfaces 153 is truncated by a generally planar surface 151 which connects to outer wall portion 158.

Figure 12:
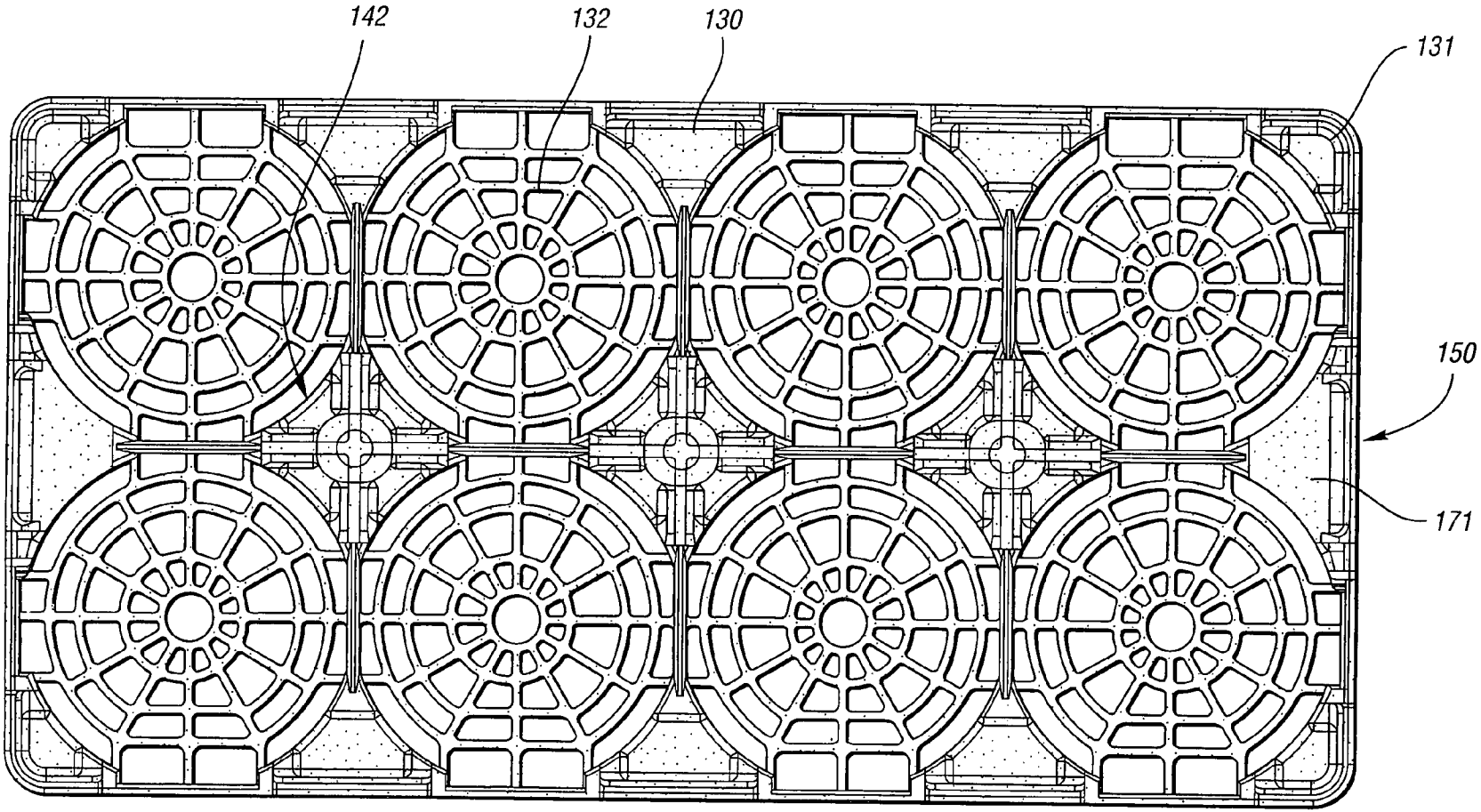
FIG. 12 is a top plan view of the second embodiment.
Figure 17:
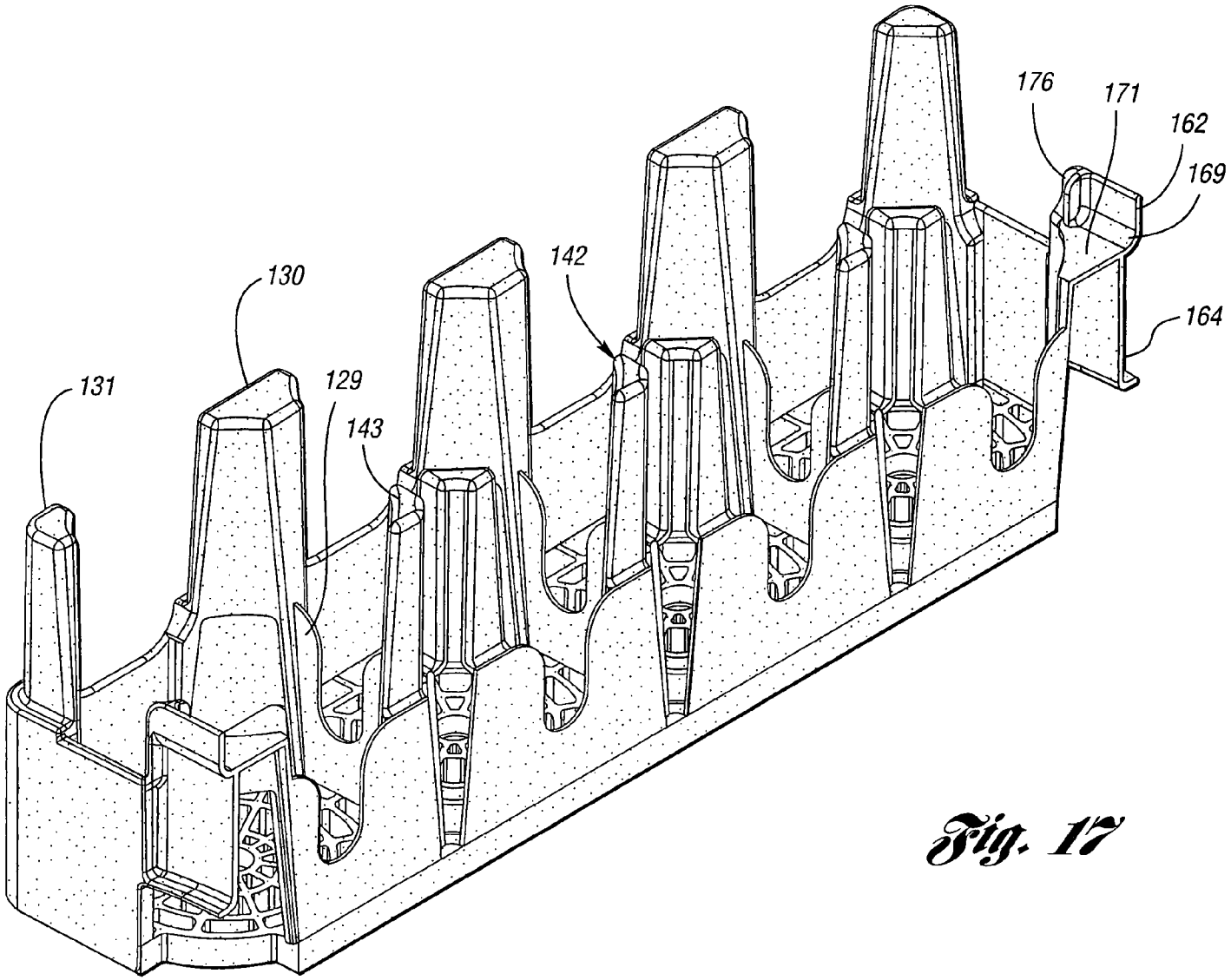
FIG. 17 is a perspective view of the cross-section shown in FIG. 16.

As shown in FIGS. 11, 16, and 17, outer wall portion 158 includes an upper portion 162 and a lower recessed portion 164. A transition portion 169 extends between upper portion 162 and lower recessed portion 164. FIGS. 11, 12, and 18 illustrate a ledge portion 171 which extends from inner wall portion 152 to transition portion 169. Ledge portion 171 is shown as attached to the upper edges of inner wall portion 152 (including flat section 155 and curved surfaces 153). Ledge portion 171 is illustrated as generally horizontally oriented. Of course, ledge 171 may be disposed at any orientation which is feasible according to the goals and objects of the present invention. Ledge 171 is a full extension of transition surface 169, which in the first embodiment partially projects into the finger opening area 60.

Figure 19:
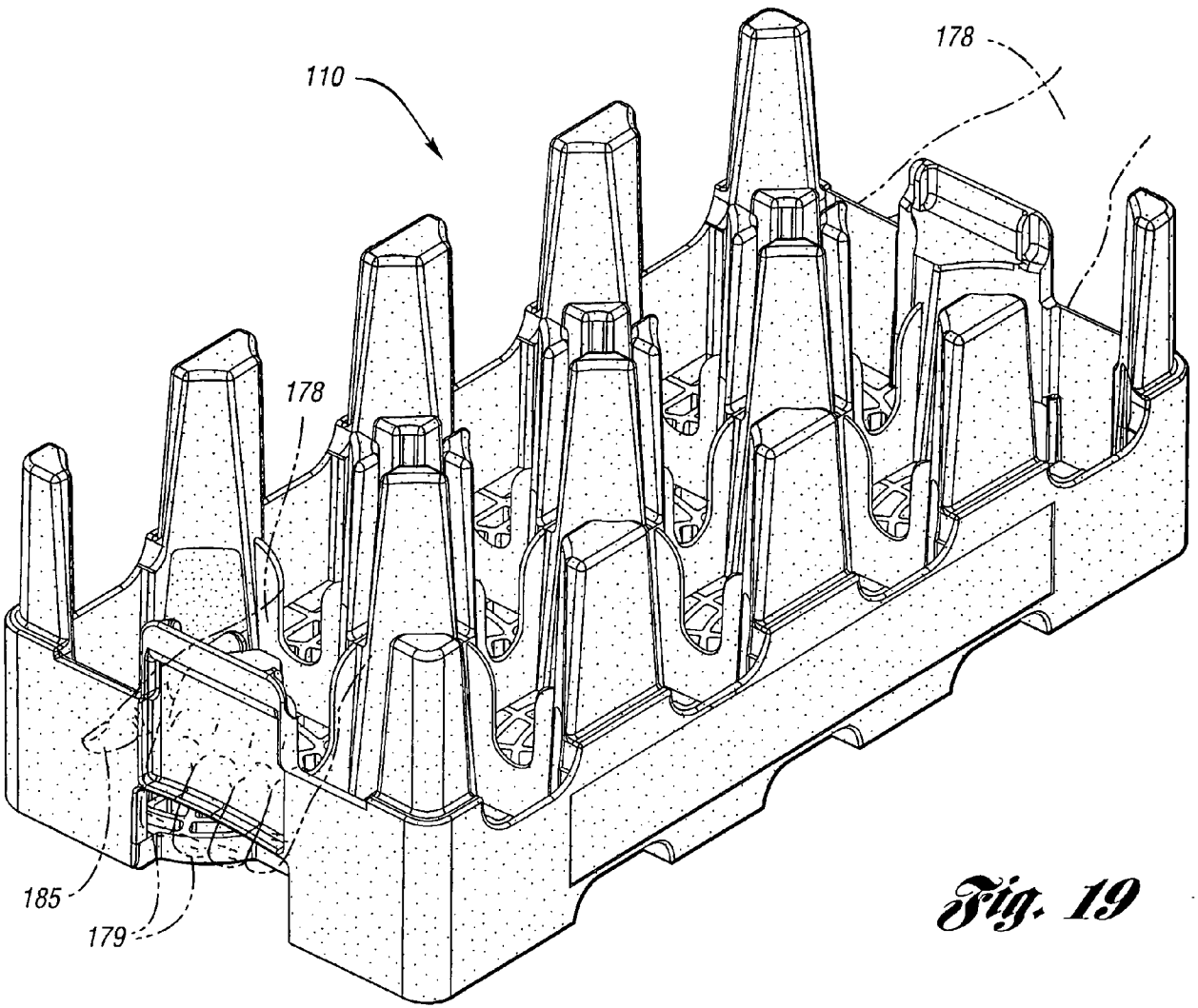
FIG. 19 is a perspective view of the case of the second embodiment showing a user's hands grasping the handle structure in a "palm-up" orientation.

As noted in FIG. 11, handle structure 150, in association with end walls 114, 118, and bottom surface 122, define finger/hand receiving area 168. Accordingly, as illustrated in FIG. 19, case 110 may be carried, lifted, or handled in a palm-up orientation, in a similar manner to that described in association with the first/preferred embodiment.

Figure 20:
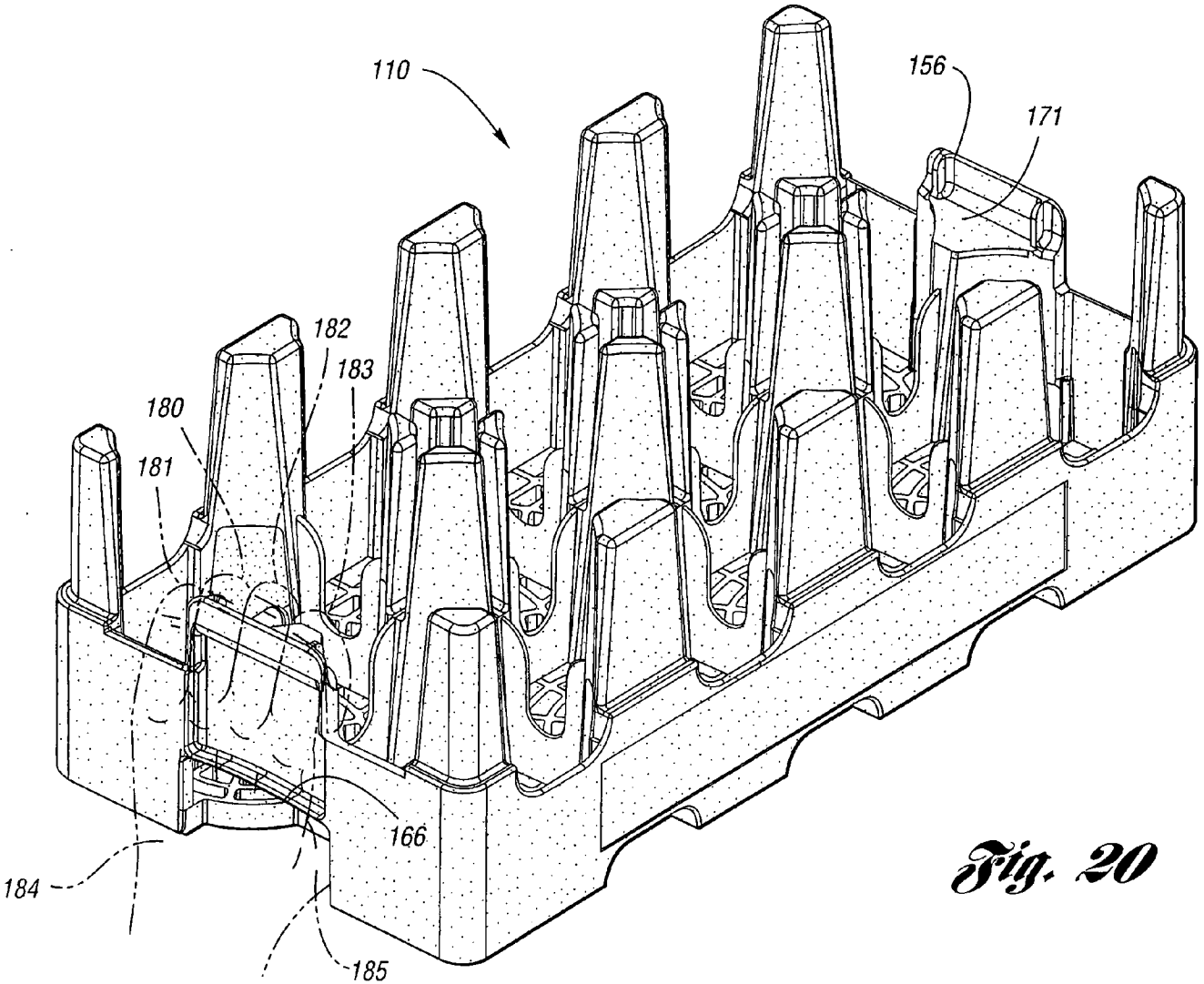
FIG. 20 is a perspective view of the case of the second embodiment showing a user's hands grasping the handle structure in a "palm-down" orientation.

With regard to the palm-down orientation for case 110, FIG. 20 illustrates this hand orientation for the second embodiment. Again, the design is convenient for a user having to lift a case from over his head/shoulders. Therefore, a user positions his hand(s) 185 so that his fingers (typically the two middle fingers 180,182) are wrapped over upper wall portion 156 so that they rest on ledge 171. Ledge 171 defines the finger receiving area for this embodiment.

As with the first embodiment, other fingers, such as the index finger 183 and the fifth-digit finger 181 are received in finger-receiving portions 174,176 on either side of ledge 171. It is noted that in either embodiment, thumb 185 may be positioned under lower edge 166 to provide additional support when handling case 10, 110. Accordingly, the user is able to reach overhead, grasp case 110 in the palm-down orientation from its location on a shelf or on a stack of full (or partially full similar cases), and slide or maneuver a case 110 in order to gain control of and access to case 110 and its contents. As with the first embodiment, the location of ribs 170 and 172 may be changed (such as by moving them transversely inboard or outboard) in order to redefine the finger locations.

It is fully contemplated that the handle structure features disclosed according to the present invention may be also incorporated into the longitudinal side walls of cases 10, 110 (such as side walls 12, 16 and 112, 116, respectively.) This would be especially helpful in an orientation where cases are cross-stacked and the most accessible portion available to grasp is such a sidewall 12, 16, 112, 116.

It is also contemplated that the handle structure features disclosed according to the present invention may be applicable to any variety of cases, include those which retain bottles, cans, etc.

Figure 13:
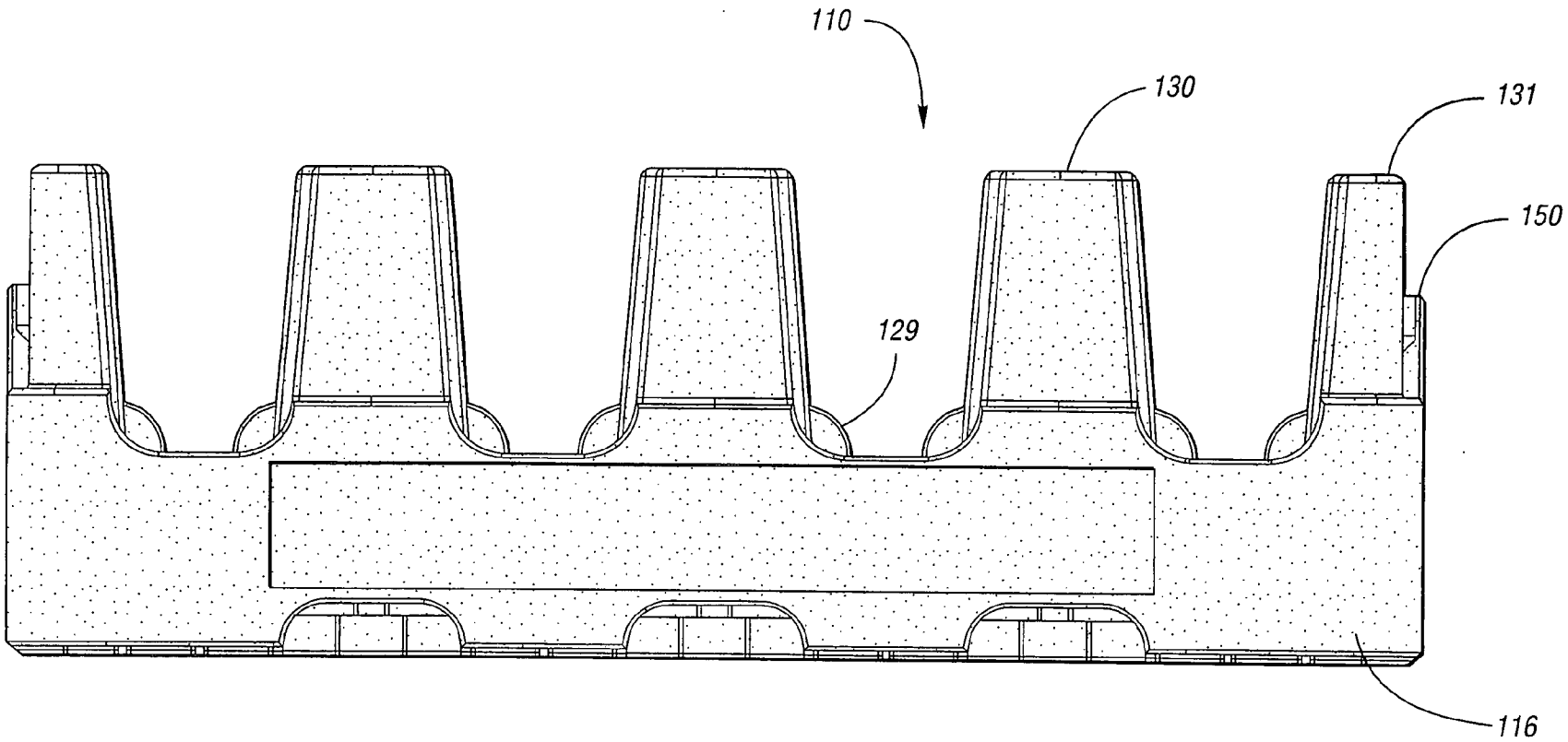
FIG. 13 is a side elevational view of the second embodiment.
Figure 14:
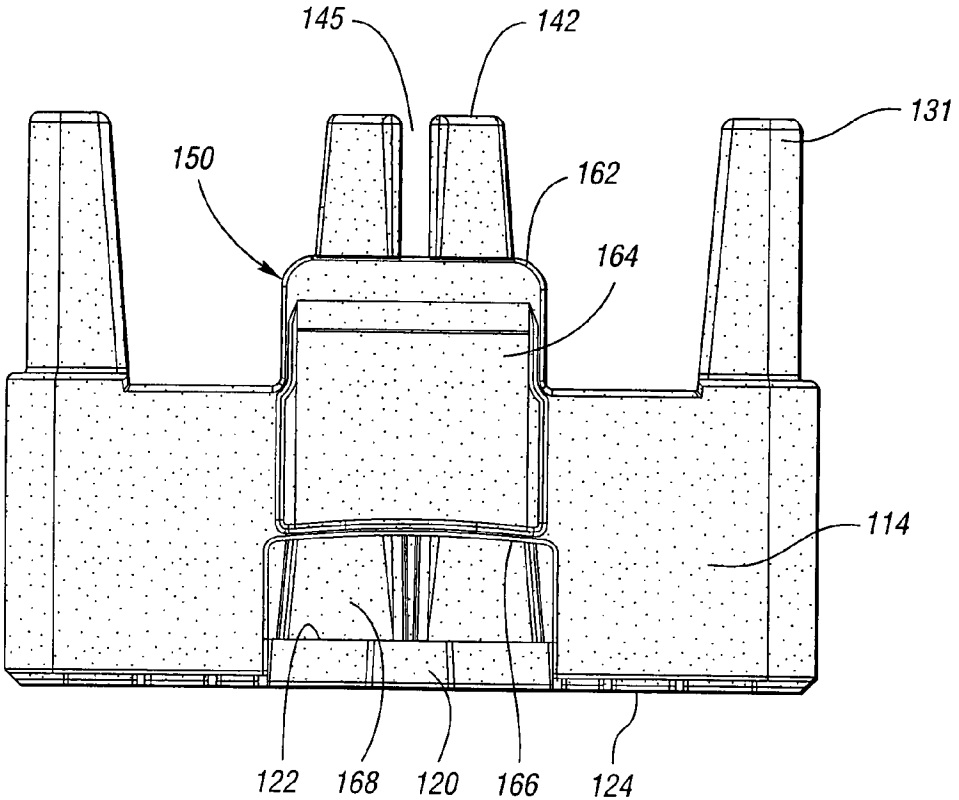
FIG. 14 is an end elevational view of the second embodiment.
Figure 15:
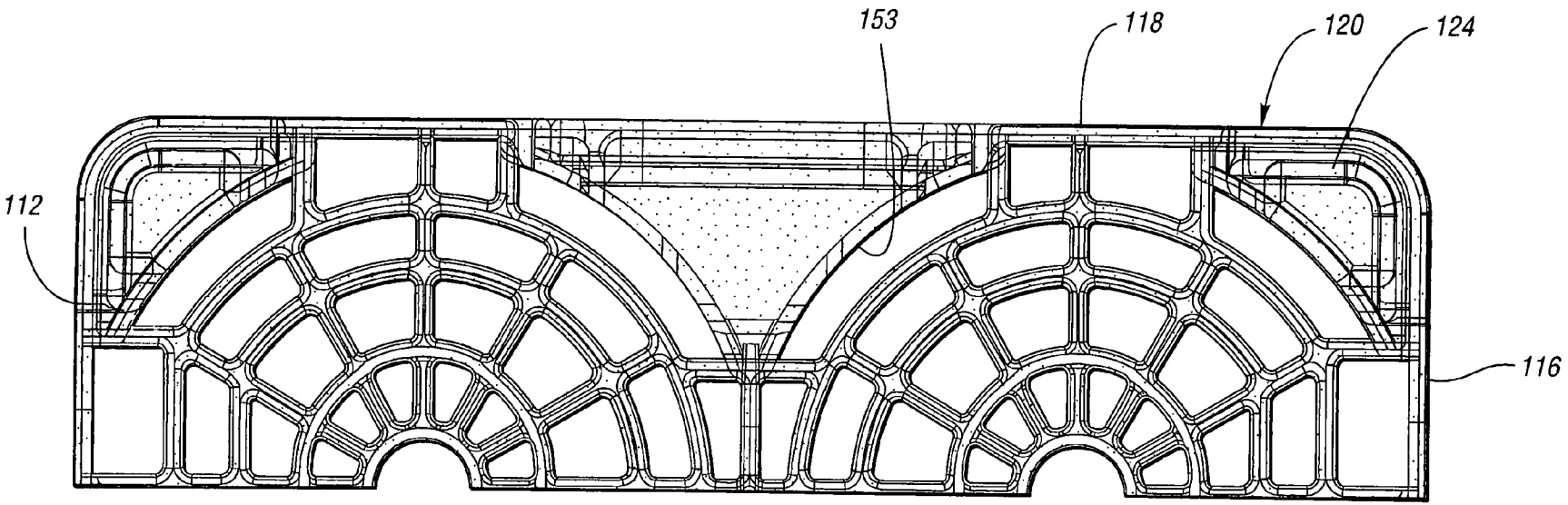
FIG. 15 is an enlarged partial bottom plan view of the second embodiment, with focus on the handle structure and end wall area.

FIG. 12 illustrates a top plan view of the second embodiment according to the present invention, wherein ledge 171 is particularly noted therein, as well as container retaining pockets 132, and columns 130, 131, and 142. FIG. 13 is an elevational side view of side wall 116 of case 110. FIG. 14 is an elevational end wall view of side wall 114 of case 110, with particular reference to handle feature 150 and its components. FIG. 15 is a partial bottom plan view of the second embodiment case 110, showing lower surface 124 of bottom portion 120. FIG. 16 is a cross-sectional view of case 110, taken along the longitudinal axis, and showing vertical walls 129, wall portions 149, recesses 147, and well as features of handle 150. FIG. 17 is a perspective view of the sectional view of FIG. 16 taken along the longitudinal axis and also illustrating lower portions of columns 142, column portions 143, and handle structure 150.

While embodiments of the invention have been illustrated and described, it is not intended that these embodiments illustrate and describe all possible forms of the invention.

Rather, the words used in the specification are words of description rather than limitation, and it is understood that various changes may be made without departing from the spirit and scope of the invention.

What is claimed is:

1. A handle structure for a low depth case for holding containers, the low depth case having a bottom portion and a pair of opposing side walls attached thereto, the handle structure adapted for handling by a user in one of a palm-up or palm-down orientation, the handle structure comprising:

an inner wall member; and an outer wall member disposed in a corresponding one of the pair of opposing sidewalls and attached to the inner wall member to define a finger receiving area therebetween, the outer wall member having an upper portion and a recessed lower portion having a lower edge, the recessed lower portion and corresponding sidewall defining a hand-opening area extending into the low depth case, at least one ledge extending outwardly from at least one edge of the recessed portion, wherein in the palm-up orientation the user's fingers extend into the hand-opening area and so that the user's palm faces up such that when the user exerts force against the lower edge, the low depth case may be raised, and wherein in the palm-down orientation, the user's fingers wrap around the upper portion of the outer wall and extend into the finger receiving area, such that the user may maneuver the low depth case.

2. The handle structure of claim 1, further including an inwardly protruding ledge forming an outer finger resting area for positioning an additional finger therein when maneuvering the case in the palm-down orientation.

3. The handle structure of claim 1 wherein the at least one ledge extends horizontally at least substantially across the recessed portion.

4. The handle structure of claim 3 wherein the at least one ledge extends substantially perpendicularly outwardly from the recessed portion.

5. A handle structure for a low depth case for holding containers, the low depth case having a bottom portion and a pair of opposing side walls attached thereto, the handle structure adapted for handling by a user in one of a palm-up or palm-down orientation, the handle structure comprising:

an inner wall member;

an outer wall member disposed in a corresponding one of the pair of opposing sidewalls and attached to the inner wall member to define a finger receiving area therebetween, the outer wall member having an upper portion and a recessed lower portion having a lower edge, the recessed lower portion and corresponding sidewall defining a hand-opening area extending into the low depth case, at least one ledge extending outwardly from at least one edge of the recessed portion; and a stop member extending into the finger receiving area to limit the extension of the user's fingers into the finger receiving area in the palm-down orientation, wherein in the palm-up orientation the user's fingers extend into the hand-opening area and so that the user's palm faces up such that when the user exerts force against the lower edge, the low depth case may be raised, and wherein in the palm-down orientation, the user's fingers wrap around the upper portion of the outer wall and extend into the finger receiving area, such that the user may maneuver the low depth case.

6. A low depth case for holding containers and adapted for maneuvering by a user, the low depth case comprising:

a bottom portion;

a first and second pair of opposing side walls attached to the bottom portion and projecting upwardly therefrom;

a plurality of central columns along a longitudinal centerline of the case, the central columns extending upwardly from the bottom portion between the first pair of opposing side walls and between the second pair of opposed side walls; and a handle structure including an outer wall member disposed in each of the first pair of opposing sidewalls and attached to an inner, single wall thickness wall member having an inner surface defining a container receiving pocket, a finger receiving area defined between an inner surface of the outer wall member and an outer surface of the inner wall member, the handle structure including a pair of ribs spaced inwardly from outermost edges of the outer wall member, the pair of ribs connecting the inner wall member to the outer wall member and defining outboard finger receiving areas, the handle structures disposed along the longitudinal centerline of the case, the outer wall member having a lower portion having a lower edge and an upper portion, the lower portion, bottom portion, and adjacent one of the first pair of opposing sidewalls defining a hand-opening area extending into the low depth case which is adapted for handling by a user in one of a palm-up or palm-down orientation, wherein in the palm-up orientation the user's fingers extend into the hand-opening area and so that the user's palm faces up such that when the user exerts force against the lower edge, the low depth case may be raised, and wherein in the palm-down orientation, the user's fingers wrap around the upper portion of the outer wall and extend into the finger receiving area, such that the user may maneuver the low depth case.

7. The low depth case of claim 6 wherein the inner wall member includes an upwardly projecting column portion which is substantially the same height as at least one of the central columns.

8. The low depth case of claim 6 wherein the inner wall member includes two curved surfaces for defining two container-retaining pockets.

9. The low depth case of claim 8 further including divider walls extending between each inner wall member and the plurality of central columns, the divider walls defining the container-retaining pockets.

10. A handle structure for a low depth case for holding containers, the low depth case having a bottom portion and a pair of opposing side walls attached thereto, the handle structure adapted for handling by a user in one of a palm-up or palm-down orientation, the handle structure comprising:

an inner wall member; and an outer wall member disposed in a corresponding one of the pair of opposing sidewalls and attached to the inner wall member to define a finger receiving area therebetween, the outer wall member having an upper portion and a recessed lower portion having a lower edge, the recessed lower portion and corresponding sidewall defining a hand-opening area extending into the low depth case, an upper ledge extending outwardly from an upper edge of the recessed portion and a lower ledge extending outwardly from the lower edge of the recessed portion;

wherein in the palm-up orientation the user's fingers extend into the hand-opening area and so that the user's palm faces up such that when the user exerts force against the lower edge, the low depth case may be raised, and wherein in the palm-down orientation, the user's fingers wrap around the upper portion of the outer wall and extend into the finger receiving area, such that the user may maneuver the low depth case.

11. A wall and handle structure assembly adapted for use in a crate for holding containers, the crate having an integrally formed bottom portion and wall structure defining a container-holding compartment therein, the wall structure including a first pair of opposed side walls and a second pair of opposed side walls, the wall and handle structure assembly comprising:

a lower wall member, the lower wall member defining at least one of the first pair of opposed side walls; and a handle structure having an outer handle member and an inner handle member, the outer handle member integrally formed with the lower wall member, the outer handle member having an outer surface having a recess, the inner handle member having a single-wall thickness wall with an inner surface defining at least one container-receiving pocket, the inner handle member extending into said compartment and attached to the outer handle member, the outer handle member and an outer surface of the wall of the inner handle member defining a finger receiving area therebetween, the wall of the inner handle member extending upwardly a first distance above a point on the lower wall member, the outer handle member extending upwardly a second distance above the point on the lower wall member, the first distance greater than the second distance, the outer handle member further having a lower surface, wherein the lower wall member, the lower surface of the outer handle member, and the bottom portion define a hand-opening area extending into the compartment to allow for handling the crate.

12. The assembly of claim 11 wherein the inner handle member extends upwardly to a height substantially equal to that of the plurality of upwardly projecting columns.

13. The assembly of claim 11 wherein the wall of the inner handle member extends upwardly the first distance above the point on the lower wall member at a center point of the handle structure.

14. The assembly of claim 11, wherein a portion of the outer handle member is co-planar with the lower wall member.

15. The assembly of claim 11, wherein the handle structure is centrally disposed relative to the lower wall member.

16. The assembly of claim 11, wherein the inner handle member extends above an upper edge of the lower wall member.

17. The assembly of claim 11, wherein the outer handle member has an upper surface which extends above an upper edge of the lower wall member.

18. The assembly of claim 11, wherein the handle structure further includes a stop member extending into the finger receiving area to limit the extension a user's fingers therein.

19. The assembly of claim 11, wherein the handle structure further includes an inwardly extending ledge defining an outboard finger resting area oriented outwardly from the finger receiving area and adapted to receive one or more user's fingers therein.

20. A wall and handle structure assembly adapted for use in a crate for holding containers, the crate having an integrally formed bottom portion and wall structure defining a container-holding compartment therein, the wall structure including a first pair of opposed side walls and a second pair of opposed side walls, the wall and handle structure assembly comprising:

a lower wall member, the lower wall member defining at least one of the first pair of opposed side walls; and a handle structure having an outer handle member and an inner handle member, the outer handle member integrally formed with the lower wall member, the inner handle member having a wall with an inner surface defining at least one container-receiving pocket, the outer handle member including a outer recess defined at least partially by the lower wall member and a ledge protruding outwardly from the outer wall member, the inner handle member extending into said compartment and attached to the outer handle member, the outer handle member and an outer surface of the wall of the inner handle member defining a finger receiving area therebetween, wherein the inner handle member extends continuously from one lateral edge of the outer handle member to an opposite lateral edge of the outer handle member, the inner handle member and outer handle member thereby circumscribing an opening through the wall and handle structure.

21. The assembly of claim 20 wherein the inner handle member extends continuously from one lateral edge of the outer handle member to the opposite lateral edge of the outer handle member in a plane above a plane defined by the lower wall member.

22. A wall and handle structure assembly adapted for use in a crate for holding containers, the crate having an integrally formed bottom portion and wall structure defining a container-holding compartment therein, the wall structure including a first pair of opposed side walls and a second pair of opposed side wails, the wall and handle structure assembly comprising:

a lower wall member, the lower wall member defining at least one of the first pair of opposed side walls; and a handle structure having an outer handle member and an inner handle member, the outer handle member integrally formed with the lower wall member, wherein a portion of an outer surface of the outer handle member is recessed relative to an outer surface of the lower wall member, the inner handle member having a wall with an inner surface defining at least one container-receiving pocket, the inner handle member extending into said compartment and attached to the outer handle member, die outer handle member and an outer surface of the wall of the inner handle member defining a finger receiving area therebetween, the wall of the inner handle member extending upwardly a first distance above a point on the lower wall member, the outer handle member extending upwardly a second distance above the point on the lower wall member, the first distance greater than the second distance, the outer handle member further having a lower surface, wherein the lower wall member, the lower surface of the outer handle member, and the bottom portion define a hand-opening area extending into the compartment to allow for handling the crate.

23. A crate for holding containers having an integrally formed bottom floor portion and wall structure defining a compartment area therein, the crate comprising:

a first and second pair of opposing side walls defining the wall structure and projecting upwardly from the bottom floor portion;

a plurality of columns projecting upwardly from the bottom floor portion alone a longitudinal centerline of the crate; and a handle structure including an outer handle member attached to at least one of the first pair of opposing side walls, an inner handle member projecting into the compartment area and defining a finger-receiving opening with the outer handle member, a divider wall substantially perpendicular to the bottom floor portion and extending substantially perpendicularly into the compartment from the inner handle member, the outer handle member further having a lower edge portion, wherein the lower edge portion, the bottom floor portion, and the at least one of the first pair of opposing sidewalls define a hand-receiving area extending into the crate which is adapted for receiving a user's hand therein, a lower ledge projecting outwardly from the outer handle member.

24. The crate of claim 23, wherein a portion of an outer surface of the outer handle member is recessed relative to the at least one of the first pair of side walls.

25. The crate of claim 23, wherein a portion of the outer handle member is coplanar with the at least one of the first pair of side walls.

26. The crate of claim 23, wherein the handle structure is centrally disposed relative to the at least one of the first pair of side walls.

27. The crate of claim 23, wherein the inner handle member extends above an upper edge of the at least one of the first pair of side walls.

28. The crate of claim 23, wherein an upper surface of the outer handle member extends above an upper edge of the at least one of the first pair of side walls.

29. The crate of claim 23, wherein the handle structure further includes a stop member extending into the finger receiving area to limit the extension of a user's fingers therein.

30. A crate for holding containers, comprising:

a bottom floor portion;

a plurality of central columns extending upwardly from the bottom floor portion; and a wall structure attached to and surrounding the bottom floor portion and defining a container-holding compartment therein, the wall structure having a first and second pair of opposed lower side walls, the wall structure further including a centrally disposed outer handle member formed integrally with and extending upwardly from each of the first pair of opposed lower side walls, and an inner handle member extending into the container-holding compartment and attached to opposite lateral ends of the outer handle member to define a first hand-receiving area opening upwardly, the outer handle member including a recess on an outer surface, the outer handle member further including a lower edge portion, wherein the lower edge portion, the bottom floor portion, and an adjacent one of the first pair of opposed lower side walls define a second hand-receiving area extending into the compartment, wherein the inner handle member extends above an upper edge of the lower side wails at a laterally center area of the wall structure, generally aligned with the plurality of central columns, wherein the inner handle member extends higher than the outer handle member.

31. The crate of claim 30, further comprising a plurality of tapered pylons extending up from the bottom floor portion and above an upper edge of the lower side walls, the pylons spaced apart and defining spaces therebetween through which containers loaded in the crate are visible.

32. The crate of claim 31, wherein the outer handle member has an upper surface which extends above an upper edge of the lower side walls.

33. The crate of claim 31, wherein the outer handle member is defined by a first wall and the inner handle member is defined by a second wall spaced apart from the first wall.

34. The low depth case of claim 31 wherein the inner handle member includes an upwardly projecting column portion which is substantially the same height as at least one of the central columns.

35. The low depth case of claim 31 wherein the inner handle member includes two curved inner surfaces defining two container-retaining pockets and two curved outer surfaces defining the first hand-receiving area with the outer handle member.

36. The low depth case of claim 35 further including divider walls extending between each inner handle member and the plurality of central columns, the divider walls further defining the container-retaining pockets.

37. A crate for holding containers, comprising:

a bottom floor portion;

a plurality of central columns extending upwardly from the bottom floor portion generally alone a longitudinal centerline; and a wall structure attached to and surrounding the bottom floor portion and defining a container-holding compartment therein, the wall structure having a lower side wall including a centrally disposed outer handle member formed integrally therewith, the wall structure further including an inner handle member extending into the container-holding compartment and attached to opposite lateral ends of the outer handle member to define a first band-receiving area opening upwardly and a second hand-receiving area opening downwardly, the outer handle member including a horizontal ledge projecting outwardly therefrom, wherein the inner handle member extends above an upper edge of the lower side walls at a lateral center of the side wall, generally aligned laterally with the plurality of central columns, and wherein the inner handle member extends higher than the outer handle member.

38. The crate of claim 37, wherein the outer handle member has an upper surface which extends above an upper edge of the lower side wall.

39. The crate of claim 37, wherein the outer handle member is a first wall and the inner handle member is a second wall spaced inwardly from the first wall.

40. The low depth case of claim 39 wherein the inner handle member includes an upwardly projecting column portion which is substantially the same height as at least one of the central columns.

* * * * *

UNITED STATES PATENT AND TRADEMARK OFFICE

CERTIFICATE OF CORRECTION

PATENT NO. : 7,097,033 B2
APPLICATION NO. : 10/227631
DATED : August 29, 2006
INVENTOR(S) : Koefelda et al.

It is certified that error appears in the above-identified patent and that said Letters Patent is hereby corrected as shown below:

IN THE CLAIMS:

Column 11, Claim 12, Line 42 of the issued patent, “the” should read as --a--.

Column 13, Claim 30, Line 60 of the issued patent, “wails” should read as --walls--.

Signed and Sealed this

Twelfth Day of December, 2006

JON W. DUDAS
*Director of the United States Patent and Trademark Office*